US009452367B2

(12) United States Patent
Schmid

(10) Patent No.: US 9,452,367 B2
(45) Date of Patent: Sep. 27, 2016

(54) TOY STRUCTURE WITH ACTUATOR

(71) Applicant: Mattel, Inc., El Segundo, CA (US)

(72) Inventor: Paul William Schmid, Ojai, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/479,740

(22) Filed: Sep. 8, 2014

(65) Prior Publication Data

US 2015/0093964 A1 Apr. 2, 2015

Related U.S. Application Data

(60) Provisional application No. 61/884,690, filed on Sep. 30, 2013.

(51) Int. Cl.

| | |
|---|---|
| ***A63H 33/00*** | (2006.01) |
| ***A63H 18/02*** | (2006.01) |
| ***A63H 17/44*** | (2006.01) |

(52) U.S. Cl.

CPC ..... *A63H 18/025* (2013.01); *A63H 17/44* (2013.01)

(58) Field of Classification Search

CPC ..... A63H 33/00; A63H 17/02; A63H 3/52; A63H 33/003; A63H 33/42; E04B 2/827; E04B 7/166

See application file for complete search history.

(56) References Cited

U.S. PATENT DOCUMENTS

| | | | | |
|---|---|---|---|---|
| 276,539 | A * | 4/1883 | Reed | 446/4 |
| 2,757,482 | A | 8/1956 | Brown et al. | |
| 3,341,987 | A | 9/1967 | Johansson | |
| 3,841,018 | A * | 10/1974 | Reiling, Jr. | 446/232 |
| 4,139,967 | A * | 2/1979 | Kuna et al. | 446/241 |
| 4,161,081 | A * | 7/1979 | Katzman et al. | 446/314 |
| 4,219,198 | A * | 8/1980 | Meyer et al. | 273/399 |
| 4,261,133 | A * | 4/1981 | Hanson et al. | 446/397 |
| 4,536,162 | A * | 8/1985 | Ace et al. | 446/102 |
| 4,661,080 | A | 4/1987 | Goldstein et al. | |
| 4,867,723 | A * | 9/1989 | Asbach | 446/4 |
| 5,074,819 | A * | 12/1991 | Stadnyk | 446/4 |
| 5,183,427 | A | 2/1993 | Draper | |
| 5,207,793 | A * | 5/1993 | Brand et al. | 273/445 |
| 5,380,231 | A | 1/1995 | Brovelli | |
| 5,397,260 | A | 3/1995 | Tilbor et al. | |
| 5,815,987 | A * | 10/1998 | Beasley | 52/65 |
| 6,099,380 | A * | 8/2000 | Rasmussen | 446/478 |
| 6,935,920 | B1 * | 8/2005 | Wa | 446/444 |
| 8,591,284 | B2 * | 11/2013 | Dubois | 446/476 |
| 2006/0286891 | A1 * | 12/2006 | Knight et al. | 446/75 |
| 2008/0009219 | A1 * | 1/2008 | Nuttall et al. | 446/168 |
| 2008/0081536 | A1 * | 4/2008 | Payne et al. | 446/75 |
| 2008/0113585 | A1 * | 5/2008 | Payne et al. | 446/444 |
| 2008/0118900 | A1 * | 5/2008 | Salerni | 434/258 |

* cited by examiner

*Primary Examiner* — Michael Dennis
*Assistant Examiner* — Urszula M Cegielnik

(57) ABSTRACT

A toy apparatus includes a base having a first surface, a wall movably coupled to the base, and an actuation element located on the first surface of the base. The actuation element is rotatably coupled to the base, the actuation element being rotatable relative to the base in a first direction and in a second direction opposite the first direction. The actuation element includes a main body, and first and second extensions coupled to the main body. The first extension has first and second engageable surfaces, the actuation element rotating in the first direction when a force is applied to the first engageable surface and in the second direction when a force is applied to the second engageable surface. The second extension engages and moves the wall relative to the base when the actuation element rotates.

20 Claims, 3 Drawing Sheets

TOY STRUCTURE WITH ACTUATOR

RELATED APPLICATIONS

This application claims priority to U.S. Provisional Patent Application No. 61/884,690 filed on Sep. 30, 2013 and entitled "Toy Structure With Actuator," which is hereby incorporated by reference for all purposes.

BACKGROUND

Toy structures that are collapsible or destructible have long been a source of entertainment for children. For example, buildings, bridges and ships have been configured to break apart when a projectile impacts the object. The projectile may be, for example, a toy missile, cannon or toy car. Structures have been configured to collapse due to the direct impact of the projectile itself, or due to the projectile impacting a particular target zone that triggers the release of the structure's components.

As the popularity of collapsible toy structures remains, there continues to be a need for new and creative designs to increase play value for the user.

SUMMARY

A toy apparatus includes a base having a surface, a wall movably coupled to the base, and an actuation element located on the surface of the base. The actuation element is rotatably coupled to the base, the actuation element being rotatable relative to the base in a first direction and in a second direction opposite the first direction. The actuation element includes a main body, and first and second extensions coupled to the main body. The first extension has first and second engageable surfaces, the actuation element rotating in the first direction when a force is applied to the first engageable surface and in the second direction when a force is applied to the second engageable surface. The second extension engages and moves the wall relative to the base when the actuation element rotates.

In some embodiments a toy apparatus includes a base having a support with an angled upper surface, a wall movably coupled to the base, and an actuation element coupled to the base. The actuation element engages the angled upper surface of the support, and is rotatable between a first position in which the actuation element does not engage the wall and a second position in which the actuation element engages the wall. The actuation element rotates relative to the base when a force is applied to the actuation element, the angled upper surface causing the actuation element to return to the first position.

In one embodiment the wall is a side wall of a toy house. In one embodiment the wall has an upper edge configured to support a roof portion. In one embodiment the wall moves to a collapsed state when the actuation element engages the wall. In one embodiment the first extension is configured as a vertical plate.

In another embodiment a third extension is coupled to the main body and spaced apart from the second extension, the second extension engaging and moving the wall when the actuation element is rotated in the first direction, and the third extension engaging and moving the wall when the actuation element is rotated in the second direction.

In some embodiments the first surface of the base has a support with an angled upper surface, the main body of the actuation element being seated on the support and having a lower surface that rides on the angled upper surface of the support. In one embodiment, the lower surface slides on the angled upper surface of the support. In one embodiment, the actuation element has an initial position in which the actuation element does not engage the wall, and has an actuated position in which the actuation element engages the wall, wherein the angled upper surface of the support enables the actuation element to return to the initial position when the force is removed from the first extension. In one embodiment, the actuation element returns to the initial position solely due to gravity.

In certain embodiments the base includes a track on which a toy vehicle travels, the first extension extending at least partially across the track when the actuation element is in the initial position. In one embodiment the toy vehicle contacts and imparts a force on the first engageable surface when the toy vehicle traverses the track in a forward direction, and the toy vehicle contacts and imparts a force on the second engageable surface when the toy vehicle traverses the track in a direction opposite the forward direction.

In another embodiment, a toy apparatus comprises a base having a support with an angled upper surface; a movable portion coupled to the base; and an actuation element coupled to the support of the base and engaging the angled upper surface of the support, the actuation element being placeable in a first position in which the actuation element does not engage the movable portion and in a second position in which the actuation element engages the movable portion, the actuation element rotating relative to the base when a force is applied to the actuation element, the angled upper surface causing the actuation element to return to the first position when the force is removed from the actuation element.

In an alternative embodiment, the actuation element comprises a body, a first extension coupled to the body, and a second extension coupled to the body, the first extension having a first engageable surface and a second engageable surface, the actuation element rotating in a first direction when a first force is applied to the first engageable surface, and the actuation element rotating in a second direction when a second force is applied to the second engageable surface.

In another embodiment, the base comprises a track on which a toy vehicle can travel, and the first extension extends at least partially across the track in an initial position.

In another embodiment, gravity moves the actuation element back to an initial position in a direction opposite to the direction in which the first force or the second force was applied to the actuation element.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

An actuator is disclosed that initiates the collapse of a toy structure, where the toy structure also has a pathway or track upon which a toy vehicle may travel. The actuator, which may also be referred to as an actuation element, is engaged by the toy vehicle as the toy vehicle traverses the pathway and consequently causes the toy structure to collapse. The actuator is engageable by the toy vehicle moving in either direction on the pathway, and also can return to its initial position without the use of a biasing element or other mechanism.

Figure 1:
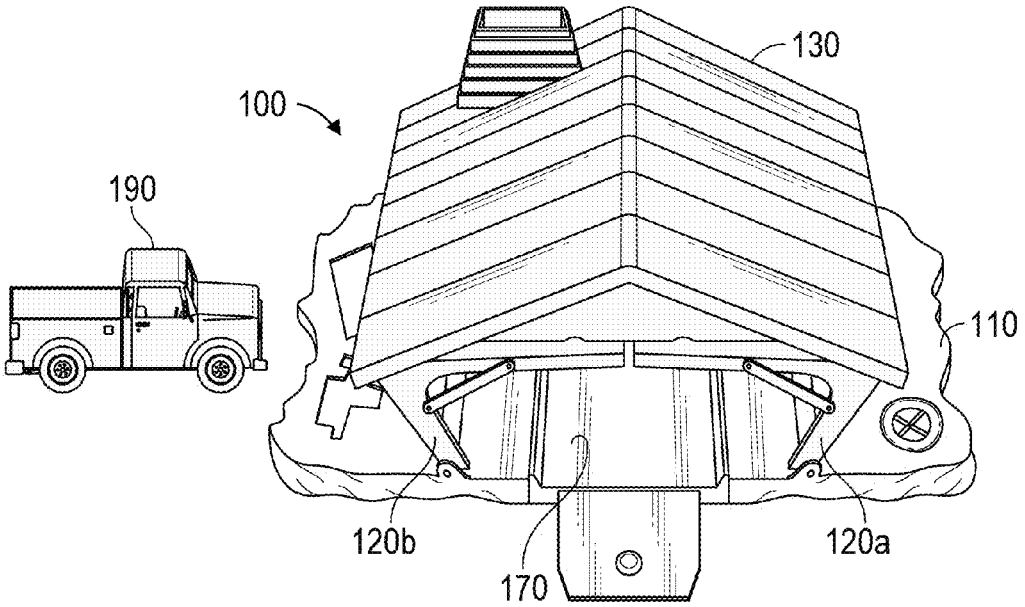
FIG. 1 is a perspective view of a toy structure in an assembled state, in one embodiment.

FIG. 1 shows a perspective view of an exemplary toy structure 100, configured as a toy house, shed or shack in this embodiment. Toy structure 100 includes a base 110, walls 120 (embodied here as two walls 120*a* and 120*b*), and a roof 130 seated on the upper ends of the walls 120. Walls 120 are embodied here as side walls positioned on opposite sides of toy structure 100. Base 110 also includes a pathway or track 170, allowing a toy vehicle 190 to traverse through the toy structure 100. In FIG. 1, toy structure 100 is in an assembled state, with the walls 120 upright and roof 130 resting on walls 120. Note that although the figures in this disclosure shall be described in relation to a house structure, other types of structures are possible such as an office building, an automobile repair garage, a dock for a ship, an airplane hanger, a spacecraft, or the like. References to a wall of the structure may be applicable to other movable portions coupled to the base, such as a piece of furniture, a panel, a door, or the like. Similarly, all references to a toy vehicle herein shall apply to other types of moving objects such as, but not limited to, cars or automobiles, trains, water vehicles, aircraft, and the like.

Figure 2:
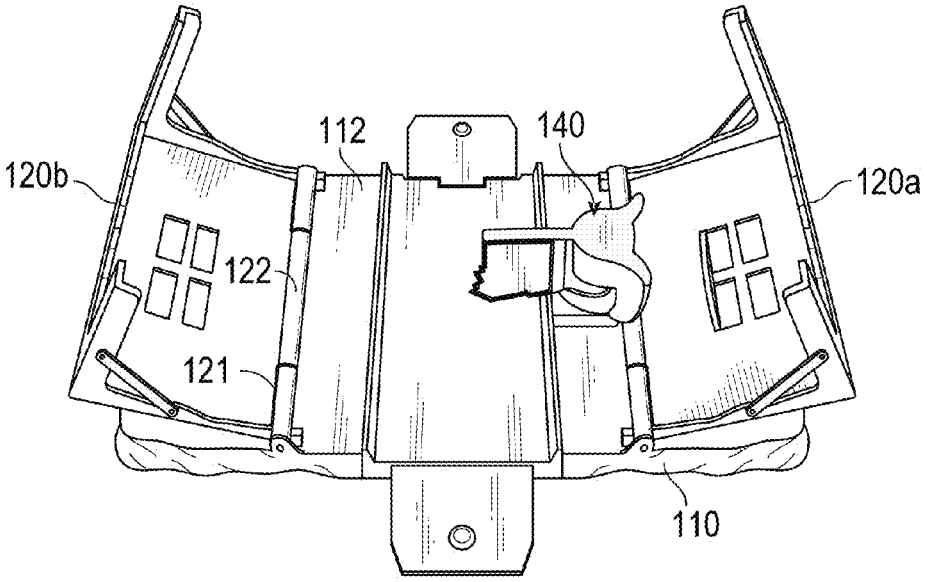
FIG. 2 is a top perspective view of the toy structure of FIG. 1, in a collapsed state.

FIG. 2 is a top perspective view of the toy structure 100 in a collapsed state resulting from when an actuation element 140 engages the wall 120*a*. In the collapsed state, walls 120 have been pivoted outward via hinges 122 that couple a bottom edge 121 of walls 120 to base 110. That is, walls 120 are movably coupled to the base 110, and the walls 120 have moved from a first position of being vertical and upright, to a second position in which they are pivoted outward along a horizontal axis, where the walls 120 are spread apart and simulate lying on the ground, such as after an explosion. In other embodiments, walls 120 may have a collapsed or disassembled state in which the walls 120 have different positions, such as being pivoted around a vertical axis, being slid laterally outward relative to the base 110, or becoming detached from the base 110. The walls 120 are moved to the collapsed state by activation of an actuation element 140, which is coupled to base 110. In this embodiment, actuation element 140 is located on a surface 112 of base 110, and is rotatably coupled to base 110. Surface 112 is a top surface of base 110 in FIG. 2. However, in other embodiments the actuation element 140 may be coupled to a different surface of base 110, such as being mounted to an inclined or stepped surface of the base 110.

Figure 3:
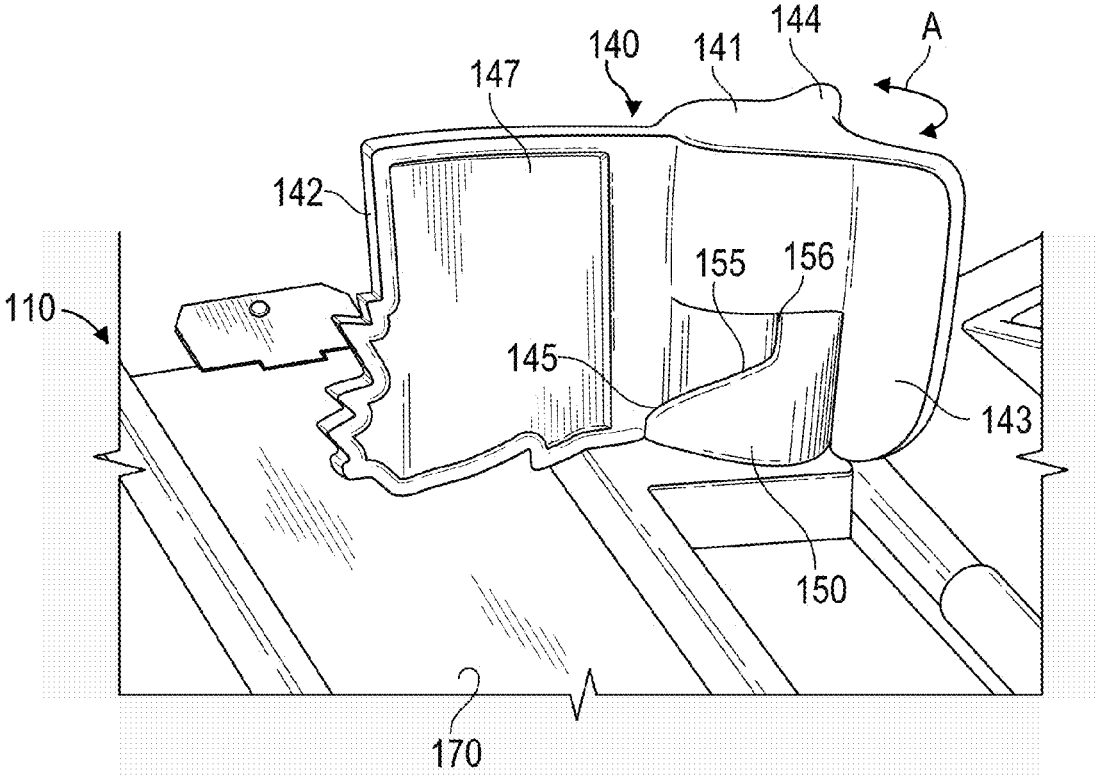
FIG. 3 is a detailed front perspective view of one embodiment of an actuation element, in an initial position.

FIG. 3 provides a close-up view of actuation element 140 in its initial position, where it is positioned at least partially across pathway 170 to encounter a toy vehicle. Actuation element 140 includes a main body 141, a first extension 142, a second extension 143, and a third extension 144. First extension 142, second extension 143, and third extension 144 are coupled to the main body 141 of actuation element 140, such as being integral with main body 141 in this embodiment. The extensions or actuating plates or portions 142, 143, and 144 are embodied here as generally vertical plates that extend radially outward from main body 141, and are spaced apart from each other around the periphery of main body 141. In other embodiments, extensions 142, 143, and 144 may be configured with other shapes such as, but not limited to, a horizontal arm, a curvilinear extension, or a plurality of protrusions. First extension 142 is configured to extend at least partially into the pathway of track 170, such that the vehicle 190 will engage and contact first extension 142 as it traverses track 170. Second and third extensions 143 and 144 are placed proximate to the wall 120*a* when the actuation element 140 is in this initial position shown in FIG. 3. At least one of the second and third extensions 143 and 144 is configured to engage and move the wall 120*a* relative to the base 110 when the actuation element 140 rotates. For example, extensions 143 and 144 may be immediately adjacent to side wall 120*a*, or may be close enough such that when the actuation element 140 rotates, the extensions 143 and/or 144 come into contact with side wall 120*a*. Note that in some embodiments, third extension 144 need not be included, while in other embodiments, more than three extensions may be present. Extensions 143 and 144 may be sized and positioned on actuation element 140 as appropriate to achieve the desired effect for initiating collapse of the toy structure 100. For instance, extensions 143 and 144 that are sized and placed closer to wall 120 will cause a more immediate destruction of the toy structure 100 when a vehicle pushes on first extension 142. Conversely, a larger gap between extensions 143 and 144 and wall 120 will require a vehicle to displace first extension 142 by a larger amount before toy structure 100 collapses. A delay may allow, for example, the toy vehicle 190 to escape from the building before the structure is destroyed.

In the embodiment of FIG. 3, main body 141 is configured as a post that is received by a support 150 on base 110. Support 150 is configured with a cylindrical opening to receive at least a portion of main body 141. Thus, main body 141 is movably coupled to base 110, through support 150, and can rotate on the upper surface of support 150 clockwise and counterclockwise, as indicated by arrow A. That is, with main body 141 seated in the cylindrical cavity provided by support 150, the actuation element 140 is rotatable relative to the base 110 in a first direction and in a second direction opposite the first direction as shown by arrow A.

Referring to FIG. 3, support 150 has an upper surface 155 that is angled or tapered relative to base 110 along at least a portion of its circumference. Although only a front half of support 150 is visible in FIG. 3, it can be understood that a similarly angled upper surface 155 is configured on a back half of the support 150. A lower surface 145, embodied here as the bottom inner edge of first extension 142, engages with angled upper surface 155 as actuation element 140 rotates. Lower surface 145 of actuation element 140 is at the lowest point of angled upper surface 155 in the initial position of actuation element 140; that is, the initial position when actuation element 140 is set to initiate a collapse of the toy structure 100. As first extension 142 is rotated away from its initial position, such as from application of a force imparted on first extension 142 by toy vehicle 190 traversing track 170, lower surface 145 of the actuation element 140 rides upward on upper surface 155 of support 150. In this embodiment, a step 156 at the upper end of upper surface 155 serves as a stop for limiting the rotation of actuation element 140.

Figure 4:
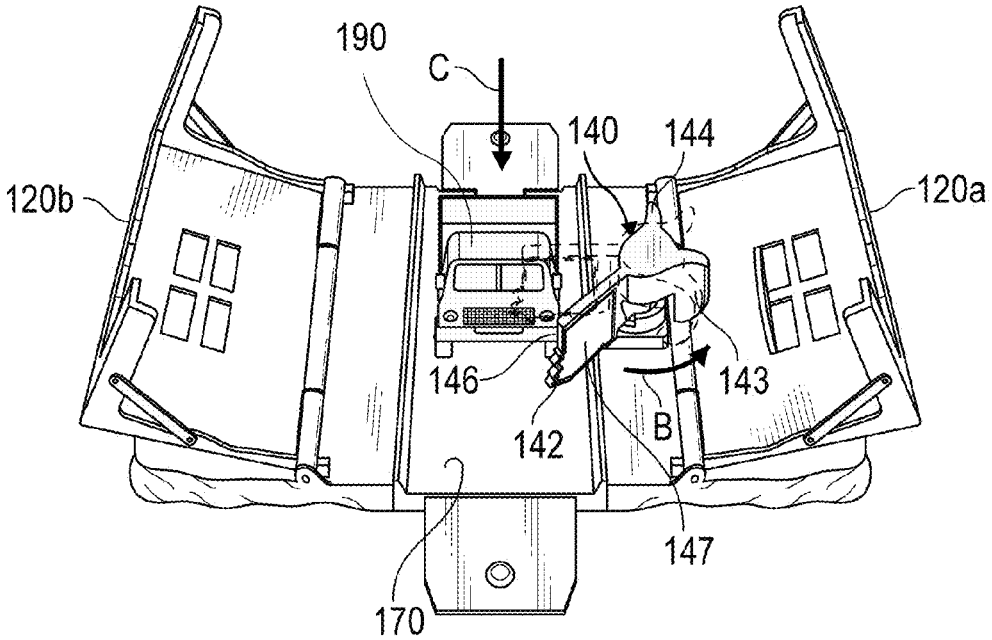
FIG. 4 is a perspective view of the actuation element of FIG. 3 in an actuated position.

An exemplary counter-clockwise rotation of actuation element 140 from the initial position (dashed lines) is shown in FIG. 4, the rotation being indicated by arrow B. This counter-clockwise rotation is due to a force being applied to a back surface 146 of first extension 142, such as a force applied by the toy vehicle 190 traveling in the direction shown by arrow C. Back surface 146 is an engageable surface in that it is positioned and sized for the toy vehicle 190 to apply a force to it. The displaced position of actuation element 140 in FIG. 4 shows the actuation element 140 being rotated in a first (counterclockwise) direction around a generally vertical axis in this embodiment. This rotation causes the second extension 143 to engage wall 120*a*. That is, second extension 143 contacts wall 120*a*, causing it to fall or pivot outward. When the wall 120*a* pivots outwardly, the roof 130 moves as well, thereby affecting the balance of wall 120*b*, with wall 120*b* moving outwardly relative to the base. Thus, the actuation element 140 is placeable in a first position in which the actuation element 140 does not engage the wall 120a or other movable portion, and is placeable in a second position in which the actuation element 140 engages the movable portion. The actuation element 140 rotates relative to the base 110 when a force is applied to the actuation element 140, the angled upper surface 155 causing the actuation element 140 to return to the first position when the force is removed from the actuation element 140.

In further play modes, the toy vehicle 190 traversing track 170 in a direction opposite of arrow C would contact and impart a force on a front surface 147 of first extension 142, which would cause actuation element 140 to rotate clockwise. In this clockwise scenario, third extension 144, rather than second extension 143, would contact wall 120*a*. Thus, it can be understood that the actuation element 140 enables vehicles to initiate a collapse of toy structure 100 while traveling from either direction on track 170, thus increasing play value. Back surface 146 and front surface 147 are engageable surfaces, the actuation element 140 rotating in a first direction when a force is applied to the first engageable surface 146 and in a second direction when a force is applied to the second engageable surface 147. Third extension 144 is coupled to the main body 141 and spaced apart from the second extension 143, the second extension 143 engaging and moving the wall 120*a* when the actuation element 140 is rotated in the first direction, and the third extension 144 engaging and moving the wall 120 when the actuation element 140 is rotated in the second direction. Thus, the actuation element 140 rotates in a first direction when a first force is applied to the first engageable surface 146, and the actuation element 140 rotates in a second direction when a second force is applied to the second engageable surface 147. In some embodiments, gravity moves the actuation element back to an initial position in a direction opposite to the direction in which the first force or the second force was applied to the actuation element.

When a force is not being applied to first extension 142, such as when a vehicle has passed actuation element 140, the angled upper surface 155 of support 150 enables the actuation element 140 to return to its initial position. That is, actuation element 140 has an initial position in which the actuation element 140 does not engage the wall 120*a*, and has an actuated position in which the actuation element 140 engages the wall 120*a*. The angled upper surface 155 of the support 150 enables the actuation element 140 to return to the initial position when the force is removed from the first extension 142. Since lower surface 145 (FIG. 3) rests on angled upper surface 155, the angled upper surface 155 causes actuation element 140 to return to its initial position in which lower surface 145 is at the lowest point of upper surface 155. In this embodiment, the actuation element 140 returns to the initial position solely due to gravity, as a result of the weight of the actuation element 140 naturally tending to lower itself along angled upper surface 155. In other embodiments, additional mechanisms such as a spring or electrically activated switch or may be used to assist or accelerate the return of actuation element 140 to its initial position. The specific angle of upper surface 155 may be chosen to achieve a desired rate of return of actuation element 140 to its first position. For example, upper surface 155 may be configured with an angle of 30°-60° from horizontal, or less than this range for a slower return, or higher than this range for a faster return. In the embodiments shown in this disclosure, lower surface 145 of actuation element 140 slides along upper surface 155 of support 150. However, in other embodiments, other types of engagements between the two surfaces are possible, such as by rolling through the use of ball bearings. The presence of the angled or tapered surface 155 enables the actuation element 140 to return to its initial, resting position without the use of a spring or similar biasing element, or other mechanism. Thus, the present design reduces cost due to simplifying the number of components required, and also allows the actuation element to reset itself without the need for user intervention.

In the figures shown herein, roof 130 is not shown in the collapsed toy structure state, for clarity. However, the roof 130 can also contribute to the transformation of the toy structure 100 from its constructed to its destructed state. In some embodiments, as wall 120*a* starts to move away from its initial, upright position, the weight of roof 130 causes the other wall 120*b* to pivot outwardly from the base 110, in the direction opposite from wall 120*a*. Thus, displacement of the wall 120*a* by the actuation element 140 can initiate a sequence of movements that causes the entire toy structure 100 to topple. In other embodiments, the roof 130 may be spring-loaded so that it is detached from toy structure 100 upon movement of one of the walls 120. Such an embodiment can add play value in that the roof detaches in a different direction of movement than the walls of the toy structure 100.

Figure 5:
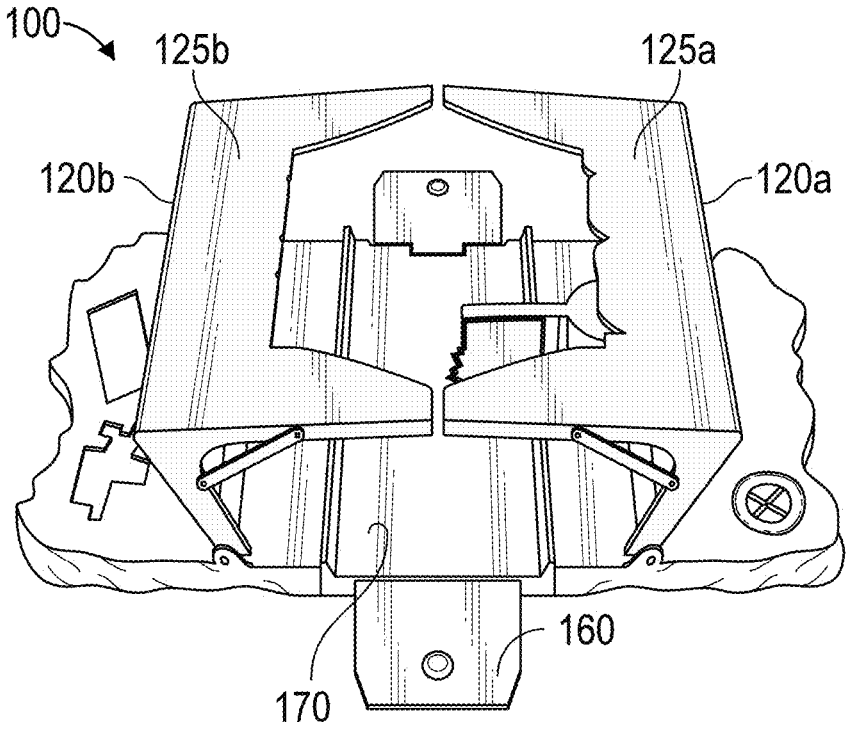
FIG. 5 is a top perspective view of the toy structure of FIG. 1, without the roof.

FIG. 5 shows another top perspective view of the toy structure 100 in the assembled state, with no roof 130 shown for clarity. It can be seen that walls 120*a* and 120*b* define a passageway through which a vehicle can travel, on track 170. A tab 160 is coupled to track 170—at both ends in this embodiment—for attaching additional pieces of roadway or tracks. Walls 120*a* and 120*b* each have an upper edge 125*a* and 125*b*, respectively, which in this embodiment provide a surface upon which roof 130 (FIG. 1) is placed and supported. In other embodiments, the upper edges 125*a* and 125*b* may be narrower strips, as minimally as may be needed to support the roof, and may further comprise a groove, protrusion, or other features to hold the roof.

Although the toy structures herein are described as comprising two sidewalls and a roof, in other embodiments the structure may comprise any number of walls, or may include intermediate panels or structures such as stairways and windows. In yet other embodiments, the vehicle pathway may or may not be enclosed by the walls of the structure. For example, the vehicle pathway may only be bordered on one side by a wall, or may be on the exterior of the toy structure, such as to simulate a street adjacent to a building. In further embodiments, the pathway may be curved, or may encounter more than one actuation element to initiate collapse of a series of toy structures.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

What is claimed is:

1. A toy apparatus comprising:

a base having a surface;

a wall movably coupled to the base; and an actuation element located on the surface of the base and rotatably coupled to the base, the actuation element being rotatable relative to the base in a first direction and in a second direction opposite the first direction, the actuation element comprising:

a main body;

a first extension coupled to the main body, the first extension having a first and second engageable surfaces, the actuation element rotating in the first direction when a force is applied to the first engageable surface and in the second direction when a force is applied to the second engageable surface; and a second extension coupled to the main body, the second extension engaging and moving the wall relative to the base when the actuation element rotates.

2. The toy apparatus of claim 1, wherein the wall is a side wall of a toy house.

3. The toy apparatus of claim 1, wherein the wall has an upper edge configured to support a roof portion.

4. The toy apparatus of claim 1, wherein the actuation element further comprises:

a third extension coupled to the main body and spaced apart from the second extension, the second extension engaging and moving the wall in a pre-determined direction when the actuation element is rotated in the first direction, and the third extension engaging and moving the wall in the pre-determined direction when the actuation element is rotated in the second direction.

5. The toy apparatus of claim 1, wherein the surface of the base has a support with an angled upper surface, the main body of the actuation element being seated on the support and having a lower surface that rides on the angled upper surface of the support.

6. The toy apparatus of claim 5, wherein the lower surface slides on the angled upper surface of the support.

7. The toy apparatus of claim 5, wherein the actuation element has an initial position in which the actuation element does not engage the wall, and has an actuated position in which the actuation element engages the wall, wherein the angled upper surface of the support enables the actuation element to return to the initial position when the force is removed from the first extension.

8. The toy apparatus of claim 7, wherein the actuation element returns to the initial position solely due to gravity.

9. The toy apparatus of claim 1, wherein the base comprises a track on which a toy vehicle travels, the first extension extending at least partially across the track when the actuation element is in the initial position.

10. The toy apparatus of claim 1, wherein the first extension is configured as a vertical plate.

11. A toy apparatus comprising:

a base having a support with an angled upper surface;

a wall movably coupled to the base; and an actuation element coupled to the base and engaging the angled upper surface of the support, the actuation element being rotatable between a first position in which the actuation element does not engage and move the wall and a second position in which the actuation element engages and moves the wall, the actuation element rotating relative to the base when a force is applied to the actuation element, the angled upper surface causing the actuation element to return to the first position.

12. The toy apparatus of claim 11, wherein the actuation element comprises a main body and a first extension coupled to the main body, the first extension having a first engageable surface and a second engageable surface, the actuation element rotating in a first direction between the first position and the second position when a force is applied to the first engageable surface, and the actuation element rotating in a second direction opposite to the first direction when a force is applied to the second engageable surface.

13. The toy apparatus of claim 12, wherein the base comprises a track on which a toy vehicle travels, the first extension extending at least partially across the track when the actuation element is in the first position.

14. The toy apparatus of claim 13, wherein the toy vehicle contacts and imparts a force on the first engageable surface when the toy vehicle traverses the track in a forward direction, and the toy vehicle contacts and imparts a force on the second engageable surface when the toy vehicle traverses the track in a direction opposite the forward direction.

15. The toy apparatus of claim 12, wherein the actuation element further comprises a second extension coupled to the main body and a third extension coupled to the main body, the first, second and third extensions being spaced apart from each other, the second extension engaging and moving the wall when the actuation element is rotated in the first direction, and the third extension engaging and moving the wall when the actuation element is rotated in the second direction.

16. The toy apparatus of claim 11, wherein the wall moves to a collapsed state when the actuation element engages the wall.

17. A toy apparatus comprising:

a base having a support with an angled upper surface;

a movable portion coupled to the base; and an actuation element coupled to the support of the base and engaging the angled upper surface of the support, the actuation element being placeable in a first position in which the actuation element does not engage and move the movable portion and in a second position in which the actuation element engages and moves the movable portion, the actuation element rotating relative to the base when a force is applied to the actuation element, the angled upper surface causing the actuation element to return to the first position when the force is removed from the actuation element.

18. The toy apparatus of claim 17, wherein the actuation element comprises a body, a first extension coupled to the body, and a second extension coupled to the body, the first extension having a first engageable surface and a second engageable surface, the actuation element rotating in a first direction when a first force is applied to the first engageable surface, and the actuation element rotating in a second direction when a second force is applied to the second engageable surface.

19. The toy apparatus of claim 18, wherein the base comprises a track on which a toy vehicle can travel, and the first extension extends at least partially across the track in an initial position.

20. The toy apparatus of claim 18, wherein gravity moves the actuation element back to an initial position in a direction opposite to the direction in which the first force or the second force was applied to the actuation element.

* * * * *